US009260672B2

(12) United States Patent
Kumar et al.

(10) Patent No.: US 9,260,672 B2
(45) Date of Patent: Feb. 16, 2016

(54) PROCESS FOR DEEP DESULFURIZATION OF CRACKED GASOLINE WITH MINIMUM OCTANE LOSS

(75) Inventors: Sarvesh Kumar, Faridabad (IN); Alok Sharma, Faridabad (IN); Brijesh Kumar, Faridabad (IN); Anju Chopra, Faridabad (IN); Santanam Rajagopal, Faridabad (IN); Kumar Ravinder Malhotra, Faridabad (IN)

(73) Assignee: INDIAN OIL CORPORATION LIMITED, Kolkata (IN)

( * ) Notice: Subject to any disclaimer, the term of this patent is extended or adjusted under 35 U.S.C. 154(b) by 0 days.

(21) Appl. No.: 13/988,316

(22) PCT Filed: Nov. 16, 2011

(86) PCT No.: PCT/IN2011/000793

§ 371 (c)(1),
(2), (4) Date: May 17, 2013

(87) PCT Pub. No.: WO2012/066572

PCT Pub. Date: May 24, 2012

(65) Prior Publication Data

US 2013/0240405 A1 Sep. 19, 2013

(30) Foreign Application Priority Data

Nov. 19, 2010 (IN) ..... 1312/KOL/2010

(51) Int. Cl.
*C10G 67/06* (2006.01)
*C10G 67/10* (2006.01)
(Continued)

(52) U.S. Cl.
CPC ..... *C10G 67/06* (2013.01); *C10G 19/02* (2013.01); *C10G 25/00* (2013.01); *C10G 27/06* (2013.01);
(Continued)

(58) Field of Classification Search
CPC ..... C10G 19/02; C10G 25/00; C10G 25/12; C10G 35/04; C10G 45/38; C10G 61/08; C10G 65/043; C10G 65/06; C10G 65/16; C10G 67/06; C10G 67/10; C10G 67/16
USPC ..... 208/57, 141, 144, 211–213, 217, 218, 208/226–230
See application file for complete search history.

(56) References Cited

U.S. PATENT DOCUMENTS 4,397,739 A 8/1983 Jacquin et al.
4,753,722 A 6/1988 Le et al.
(Continued)

FOREIGN PATENT DOCUMENTS

CA 2 330 461 A1 7/2001
WO 2005/019387 A1 3/2005

*Primary Examiner* — Renee E Robinson
(74) *Attorney, Agent, or Firm* — Maschoff Brennan

(57) ABSTRACT

The present invention provides a process for deep desulphurization of cracked gasoline with minimum octane loss of about 1-2 units. In this process full range cracked gasoline from FCC, Coker, Visbreaker etc is sent to Diolefin Saturation Reactor for selective saturation of diolefins. After saturation of diolefins, the stream is sent to Splitter for splitting into three cuts i.e Light Cut (IBP-70° C.), Intermediate Cut (70-90° C.) and Heavy Cut (90-210° C.). The Light Cut which contains majority of the high octane olefins and mercaptan sulfur is desulfurized with caustic treatment using Continuous Film Contactor (CFC). The sulfur in the Intermediate Cut is also predominantly mercaptans and the cut can be desulfurized by caustic treatment using CFC along with Light cut or separately desulfurized before being sent for isomerization. The Heavy Cut containing mainly thiophinic sulfur compounds is treated either by using conventional HDS process or reactive adsorption process.

9 Claims, 5 Drawing Sheets

(51) Int. Cl.

| | |
|---|---|
| ***C10G 67/16*** | (2006.01) |
| ***C10G 65/06*** | (2006.01) |
| ***C10G 65/16*** | (2006.01) |
| ***C10G 65/04*** | (2006.01) |
| ***C10G 61/08*** | (2006.01) |
| ***C10G 25/00*** | (2006.01) |
| ***C10G 27/06*** | (2006.01) |
| ***C10G 45/32*** | (2006.01) |
| ***C10G 67/04*** | (2006.01) |
| ***C10G 67/14*** | (2006.01) |
| ***C10G 45/02*** | (2006.01) |
| ***C10G 19/02*** | (2006.01) |
| ***C10G 67/00*** | (2006.01) |

(52) U.S. Cl.

CPC ..... *C10G 45/02* (2013.01); *C10G 45/32* (2013.01); *C10G 61/08* (2013.01); *C10G 65/043* (2013.01); *C10G 65/06* (2013.01); *C10G 65/16* (2013.01); *C10G 67/00* (2013.01); *C10G 67/0427* (2013.01); *C10G 67/10* (2013.01); *C10G 67/14* (2013.01); *C10G 67/16* (2013.01); *C10G 2300/104* (2013.01); *C10G 2300/1044* (2013.01); *C10G 2300/202* (2013.01); *C10G 2300/305* (2013.01); *C10G 2300/4006* (2013.01); *C10G 2300/4012* (2013.01); *C10G 2400/02* (2013.01)

(56) References Cited

U.S. PATENT DOCUMENTS

| | | | | |
|---|---|---|---|---|
| 6,007,704 | A | 12/1999 | Chapus et al. | |
| 6,334,948 | B1 | 1/2002 | Didillon et al. | |
| 6,875,340 | B2 | 4/2005 | Zong et al. | |
| 7,005,058 | B1 | 2/2006 | Towler | |
| 7,306,714 | B2 | 12/2007 | Uzio et al. | |
| 2005/0061712 | A1 | 3/2005 | Nicolaos et al. | |
| 2005/0252831 | A1 | 11/2005 | Dysard | |
| 2006/0231490 | A1* | 10/2006 | Manna et al. | 210/634 |
| 2007/0023325 | A1* | 2/2007 | Kumar et al. | 208/213 |
| 2009/0188837 | A1 | 7/2009 | Podrebarac | |

* cited by examiner

PROCESS FOR DEEP DESULFURIZATION OF CRACKED GASOLINE WITH MINIMUM OCTANE LOSS

FIELD OF THE INVENTION

The present invention in general relates to desulfurization of cracked gasoline and in particular to a process for deep desulfurization of cracked gasoline feed stock to produce products containing less than 10 ppm sulfur with octane loss not exceeding 2 units. More particularly, this invention aims at producing a product containing reduced amount of sulfur as well as diolefins content in a full range cracked gasoline to a level below 0.1%, preferably below 0.05% and most preferably 0.02%.

BACKGROUND OF THE INVENTION AND PRIOR ART

Petroleum refineries are facing the challenge of producing motor gasoline meeting stringent specifications with regard to several key properties like sulphur, olefins, octane number etc. Gasoline from FCC (Fluidized bed Catalytic Cracking or Fluid Catalytic Cracking) accounts for over 90% of the sulfur and olefins in gasoline. Sulfur can be removed from FCC gasoline by catalytic hydrodesulphurization (HDS) process. This process, however, requires high consumption of hydrogen and significantly reduces fuel octane number due to almost complete olefin saturation.

The different types of gasoline made by catalytic cracking or thermal cracking are excellent basic constituents for producing commercial motor gasoline, owing to their high content of olefinic compounds and aromatic compounds which provide high octane number to these types of gasoline. Commonly the sulfur content of these types of gasoline (which may be defined as the fraction distilling between C5 and 210° C.) depends on the sulfur content of the heavy charge subjected to catalytic cracking. Earlier the sulfur content of these fractions was lower than those of the trade specifications, after admixture with gasoline obtained by other processes as, for example, catalytic reforming. A sweetening treatment of the gasoline was performed for removing compounds of the mercaptan type, which have a substantial corrosion effect and reduce the favourable effect, on the octane number, of lead additives.

This conventional treatment does not change substantially the total sulfur content of said gasoline. Presently the increase of the sulfur content of the catalytic cracking or thermal cracking charges and the decrease of the tolerable sulfur content of motor gasoline in the trade, give a further interest to a desulfurization treatment of these gasoline which removes the sulfur without changing to a substantial extent the octane number of these gasoline.

U.S. Pat. No. 6,007,704 disclosed a process for desulphurization of catalytic cracking gasoline by fractionating into Light (C5-180° C.) and Heavy (180+° C.) cuts. The Light cut is optionally hydrogenated for saturation of dienes followed by mild hydro treatment and sweetening. The Heavy cut is hydrotreated in hydrotreatment unit. As shown in examples, there is significant loss of octane number of about 6-8 units with product sulfur of about 50 ppm.

U.S. Pat. No. 6,103,105 discloses a process for reduction of sulfur content in FCC gasoline. The heaviest fraction is hydrotreated in a hydrotreator in the first bed and the effluent is quenched with the intermediate fraction in the second bed. However, the process does not discuss anything for desulphurization of the Light cut.

U.S. Pat. No. 6,334,948 discloses a process for producing gasoline with lower sulfur content by fractionating into Light (C5-180° C.) and Heavy (180+° C.) cuts. The Light cut is hydrodesulfurized over Nickel-based catalyst and the Heavy cut is hydrodesulphurized over a catalyst comprising of at least one group VIII metal and/or at least one group VIB metal. The process shows benefit of octane loss as compared to conventional hydrodesulphurization. As shown in examples there is loss in research octane number of about 3 units with product sulfur about 324 ppm. Further deep desulfurization below 50 ppm will result more loss in octane value.

U.S. Pat. No. 7,306,714 discloses a process for desulphurizing gasoline in presence of catalyst. The process showed higher selectively for desulphurization than olefin saturation in comparison to conventional HDS process. Process is improved version of conventional HDS; however, it will still have higher loss in octane number for product sulfur below 50 ppm.

Canadian patent CA2330461C discloses a process for upgrading a heavy hydrocarbon feed containing at least 0.05 wt. % sulfur to obtain a product with a reduced sulfur content. However, it does not disclose the octane loss amount. Also, deep desulfurization is not taught.

US patent application US 2005035028(A1) discloses a process for hydrodesulfurising gas oil or vacuum distillate, preferably, a vacuum gas oil and/or vacuum distillate. It gives a method of reducing the quantity of heat to be supplied to the feed in the fractionation section which enables that section to be operated at moderate temperatures. It does not speak of deep desulfurization of gasoline feedstock, nor does it disclose the octane loss amount.

U.S. Pat. No. 4,397,739(A) discloses a process for lowering the sulfur or sulfur compounds content of a catalytic cracking or steam cracking gasoline boiling between 30° C. C. and 220° C., without substantially decreasing its octane number. The gasoline is split into two fractions of different boiling ranges. It, however, neither teach removal of mercaptan sulfur, nor reduction of benzene content of the gasoline pool.

In PCT publication WO 2005019387(A1), naphtha streams, preferably cracked naphtha streams containing both olefinic compounds and mercaptans, are first treated to convert at least a portion of the mercaptans to disulfides followed by thiophene alkylation. This results in a sufficient change in boiling range to allow for separation of at least a portion of the alkylated sulfur species and disulfides from the light naphtha. This results a low sulfur light naphtha stream with little loss in octane number. It neither teaches deep desulfurisation, nor reduction of benzene content of the gasoline pool.

However, these publications in the area of desulfurization of gasoline do not envisage deep desulfurization of cracked gasoline feedstock with minimum octane loss which has been achieved by the process of the present invention.

The main aim of the invention is to provide a process for deep desulfurization of cracked gasoline feedstocks to produce product containing <10 ppm sulfur with minimum octane loss of about 1-2 units.

Another aim of the invention is to provide a pretreatment process to reduce diolefins content of full range cracked gasoline below permissible level preferably below 0.1% more preferably below 0.05% and most preferably below 0.02%.

Yet another aim of the invention is to split pretreated gasoline into three cuts:

a) Light cut preferably IBP-120° C., more preferably IBP-90° C., most preferably IBP-70° C.

b) Intermediate cut preferably 70-120° C., more preferably 70-100° C., most preferably 70-90° C.

c) Heavy cut preferably 70-210° C., more preferably 120-210° C., most preferably 90-210° C.

Another aim of the invention is to treat Light and/or Intermediate cuts with caustic solution to remove Mercaptan sulfur using Continuous Film Contactor (CFC) preferably below 10 ppm, more preferably below 5 ppm and most preferably below 2 ppm.

A further aim of the invention is to hydrotreat Heavy cut gasoline over a CoMo or NiMo catalyst to reduce sulfur preferably below 30 ppm, more preferably below 10 ppm and most preferably below 5 ppm A still further aim of the invention is to treat Heavy cut gasoline over a reactive adsorbent to reduce sulfur preferably below 15 ppm, more preferably below 10 ppm and most preferably below 5 ppm A further aim of the invention is to send Intermediate Cut to isomerization unit as feedstock to reduce benzene content of the gasoline pool.

The above aims are attained by the present invention which relates to a process for deep desulfurization of cracked gasoline feedstock to produce product(s) containing <10 ppm sulfur with minimum octane loss not exceeding 2 units, which comprises treating full range cracked gasoline over a low activity NiMo or CoMo catalyst at a pressure varying between 5 and 10 bar, temperature in the range of 100° C. to 200° C., and hydrogen to hydrocarbon ratio varying between 5 and 25 depending on diolefin content in the feed to reduce diolefin contents below permissible level, preferably below 0.10%.

SUMMARY OF THE INVENTION

The present invention provides a process for deep desulfurization of cracked gasoline feed stocks to produce product containing <10 ppm sulfur with minimum octane loss of about 1-2 units. The gasoline feed stocks after catalytic treatment is split into three cuts, namely Light cut, Intermediate cut and Heavy cut. The Light and/or Intermediate cuts are treated with a caustic solution in a CFC to remove mercaptan sulfur and thereafter blended into a gasoline pool. Heavy cut gasoline is hydrotreated over a CoMo or NiMo catalyst using conventional HDS process or reactive adsorption process to reduce sulfur.

Another embodiment of the present invention is to reduce benzene content of the gasoline pool by sending the Intermediate cut to isomerization as feedstock. Reduction of sulfur is effected by both catalytic treatment and by treating Intermediate and/or Heavy cut gasoline over a reactive adsorbent bed, the components of which are spinel oxide prepared by solid state reaction of the individual metal oxides.

The present invention also provides a process for regeneration of spent adsorbent.

DETAILED DESCRIPTION OF THE INVENTION

The present invention discusses a process of deep desulphurization of cracked gasoline with minimum octane loss of about 1-2 units. In this process full range cracked gasoline from FCC, Coker, Visbreaker etc. is sent to 'Diolefin Saturation Reactor' for selective saturation of diolefins. After saturation of diolefins, the stream is sent to 'Splitter' for splitting into three cuts i.e. Light Cut (IBP-70° C.), Intermediate Cut (70-90° C.) and Heavy Cut (90-210° C.). The Light Cut which contains majority of the high octane olefins and mercaptan sulfur is desulfurized with caustic treatment using Continuous Film Contactor (CFC). The CFC completely removes mercaptans and hence makes stream almost free of sulfur. The sulfur in the Intermediate Cut is also predominantly mercaptans and the cut can be desulfurised by caustic treatment using CFC along with Light cut or separately desulfurised before being sent for isomerization. The Heavy Cut containing mainly thiophinic sulfur compounds is treated using conventional HDS process or reactive adsorption process.

The Light and/or Intermediate cuts referred to above are treated with caustic solution of 2 to 10% strength made in CFC (Continuous Film Contactor) in order to reduce mercaptan sulfur to a level below 10 ppm, preferably below 5 ppm and most preferably below 2 ppm, which is thereafter blended in gasoline pool.

The present invention also provides a procedure to hydrotreat Intermediate and/or Heavy cut gasoline over a CoMo or NiMo catalyst to reduce sulfur below 30 ppm, preferably below 10 ppm and most preferably below 5 ppm. The operational parameters are, for example, pressure—5 to 20 bar, temperature—250 to 300° C. and hydrogen and hydrocarbon ratio varying between 20 and 200, depending on the sulfur and olefin content in the feed.

This invention also provides a method of treatment of Intermediate and/or Heavy cut gasoline over a reactive adsorbent to reduce sulfur content below 15 ppm, preferably below 10 ppm and most preferably below 5 ppm. In this adsorption procedure, sulfur compounds present in the feedstocks are chemically adsorbed on the adsorbent followed by cleavage of of the sulfur atom from the sulfur compound and reacts with active metal components of the adsorbent and the hydrocarbon molecule of the sulfur compound is released back into the hydrocarbon stream.

The adsorbent referred to above, includes a bimetallic alloy generated in situ from mixed metal oxides and is capable of being regenerated by controlled oxidation of the adsorbed carbon and sulfur with lean air followed by activation with hydrogen. Presence of hydrogen in the course of adsorption prevents deactivation of adsorbent due to 'coking'.

The intermediate cut is subjected to isomerisation as feedstock in order to reduce benzene content of gasoline pool. Alternatively, this intermediate cut can be fed to reformer unit and light and heavy cuts may be blended into gasoline pool.

The functions of reformer and isomerization is re-arranging or re-structuring the hydrocarbon molecules in the naphtha feedstock as well as breaking some of the molecules into smaller molecules. The overall effect is that the product reformate or isomerate containing hydrocarbons with more complex molecular structure having higher octane values than the hydrocarbons in the naphtha feedstock.

BRIEF DESCRIPTION OF THE ACCOMPANYING DRAWINGS

The present invention will now be further explained with the help of the illustrative drawings accompanying this specification wherein FIG. 1 and FIG. 2 show a schematic process flow scheme.

REACTIVE ADSORPTION PROCESS

The reactive adsorption process comprises two numbers of fixed bed reactors loaded with reactive adsorbent, which are being operated in swing mode of adsorption and regeneration. During the adsorption process, gasoline feed along with hydrogen is contacted with the adsorbent in down or up flow mode at 250-350° C., 5-20 bar, hydrogen to hydrocarbon ratio of 50-200 $Nm^3/m^3$, liquid hourly space velocity of 0.5-2.0 $h^{-1}$ depending on the sulfur contents of feed. During the adsorption process, the sulfur compounds are chemically adsorbed on the adsorbent followed by cleavage of the sulfur atom form the sulfur compound. The hydrocarbon molecule of the sulfur compound is released back into the hydrocarbon stream. The presence of hydrogen during the adsorption also prevents deactivation of adsorbent due to coking. The treated gasoline contains less than 10 ppm sulfur which can be blended with other cuts to produce gasoline pool containing less than 10 ppm sulfur. After reaching the breakthrough point, the adsorbent is regenerated at 350-500° C.

Figure 1:
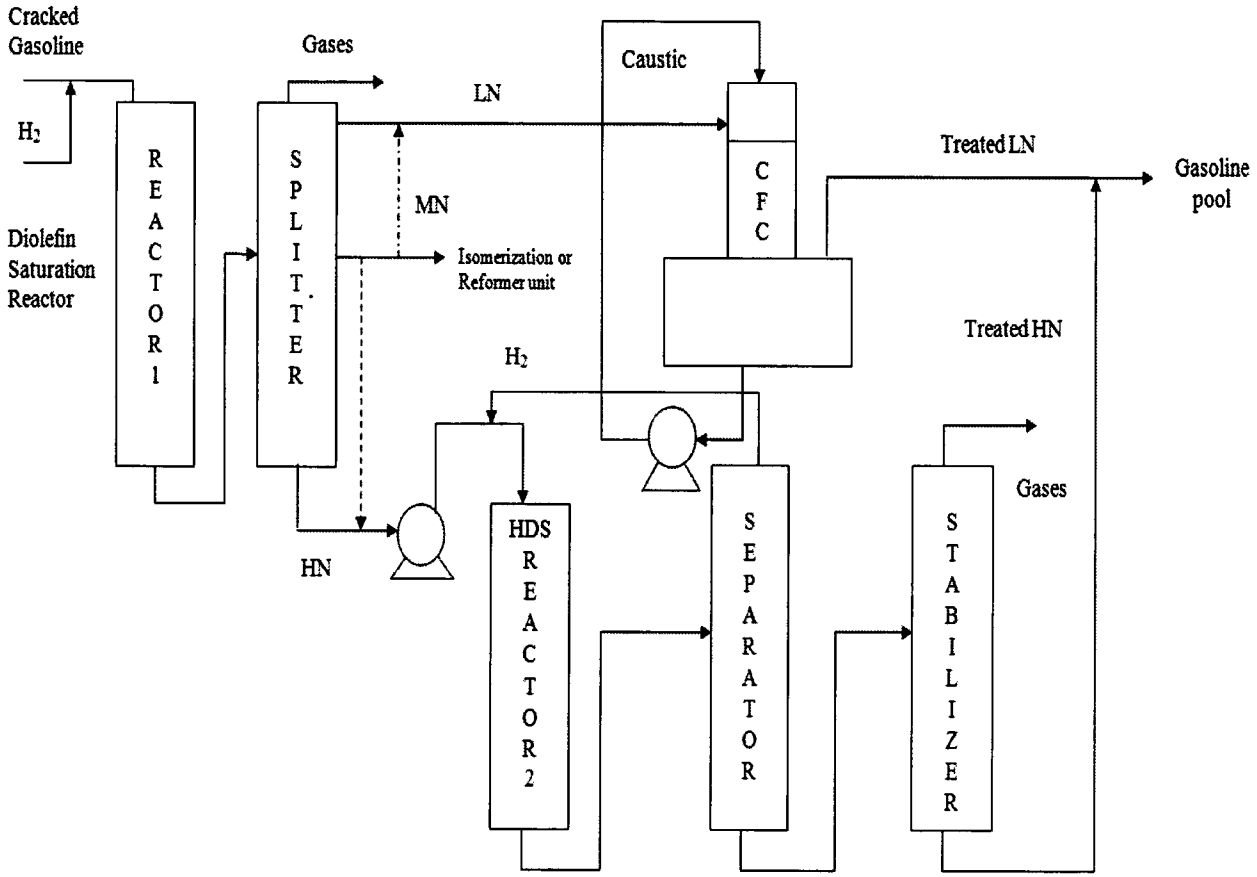
Figure 2:
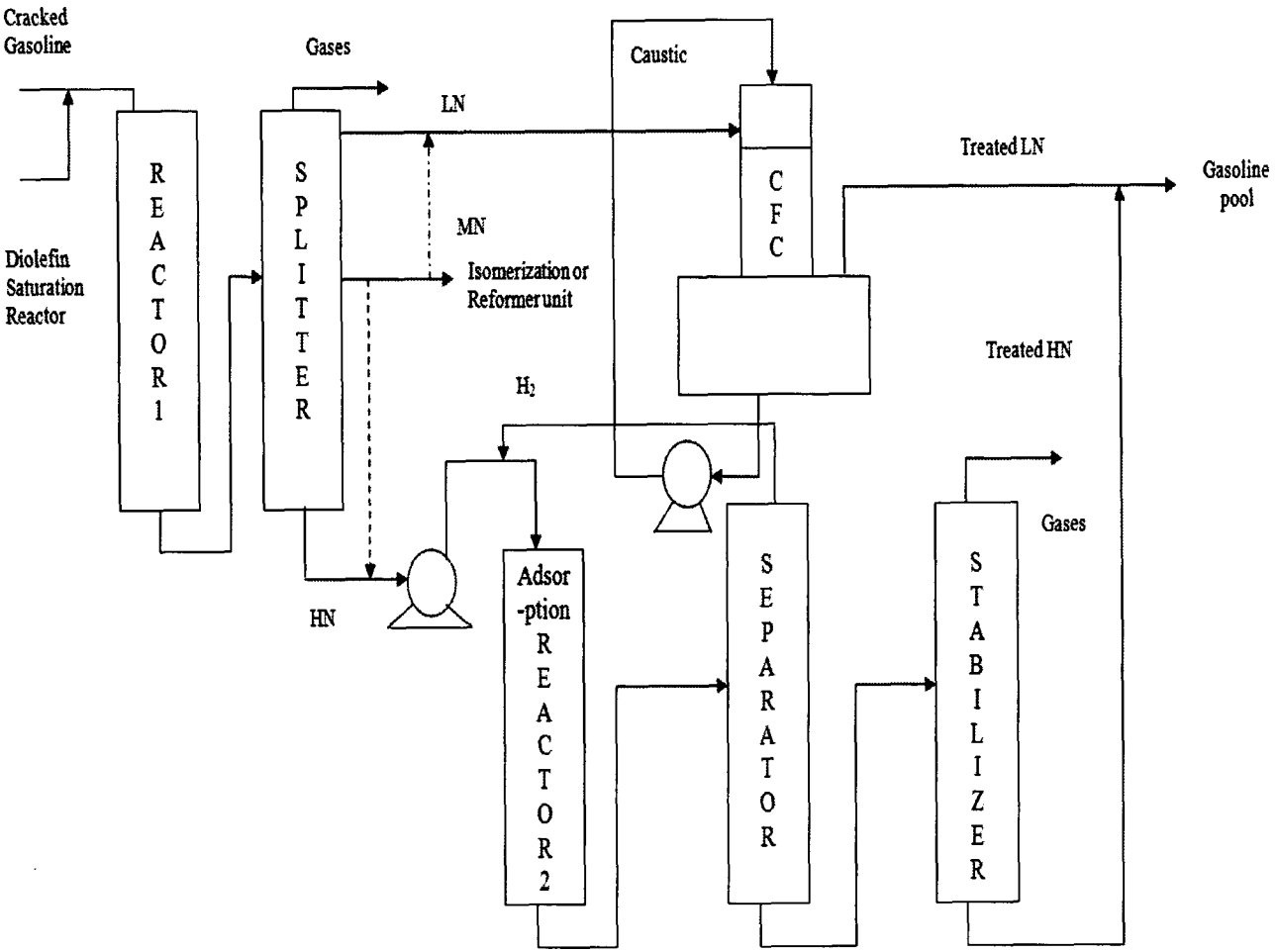
Figure 3:
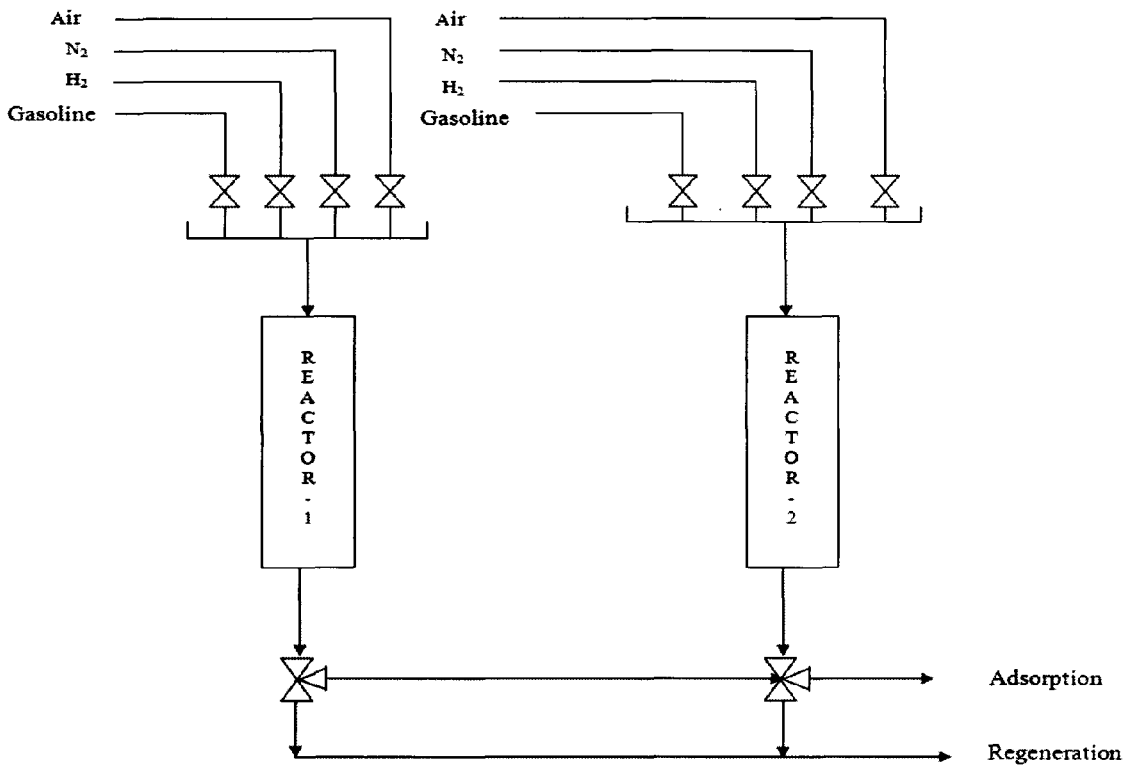
FIG. 3 shows the adsorption process scheme.

Regeneration of adsorbent is accomplished in situ by controlled oxidation of the adsorbed carbon and sulfur with lean air followed by activation with hydrogen. The cycle time will vary from 4 to 10 days depending on feed sulfur and boiling range. The adsorbent has higher strength and thermal stability compared to hydrotreating catalyst. The regenerability study for the adsorbent has been conducted in pilot plant for 6 months (25 cycles) and there was no loss of activity and physical properties, hence the life of the adsorbent is expected to be similar to that of hydrotreating catalyst systems. The Adsorption process scheme is given in FIG. 3.

Adsorbent

The adsorbent used in the process is disclosed in prior art (US 2007/0023325) and is comprised of a base component, a reactive component, and booster. The base component of adsorbent is a porous material, which provides extrudibility and strength. Such materials include alumina, clay, magnesia, titania or a mixture of two or more such materials. The reactive component of the adsorbent is a spinel oxide and prepared through solid-state reaction of the individual metal oxides. This component is responsible for detaching the sulfur atom from the sulfur compounds. The activity booster component of the adsorbent is a bimetallic alloy generated in situ from mixed metal oxides.

The invention is further explained by the examples given below by way of illustration and not by way of limitation

EXAMPLES

Example-1

Figure 4:
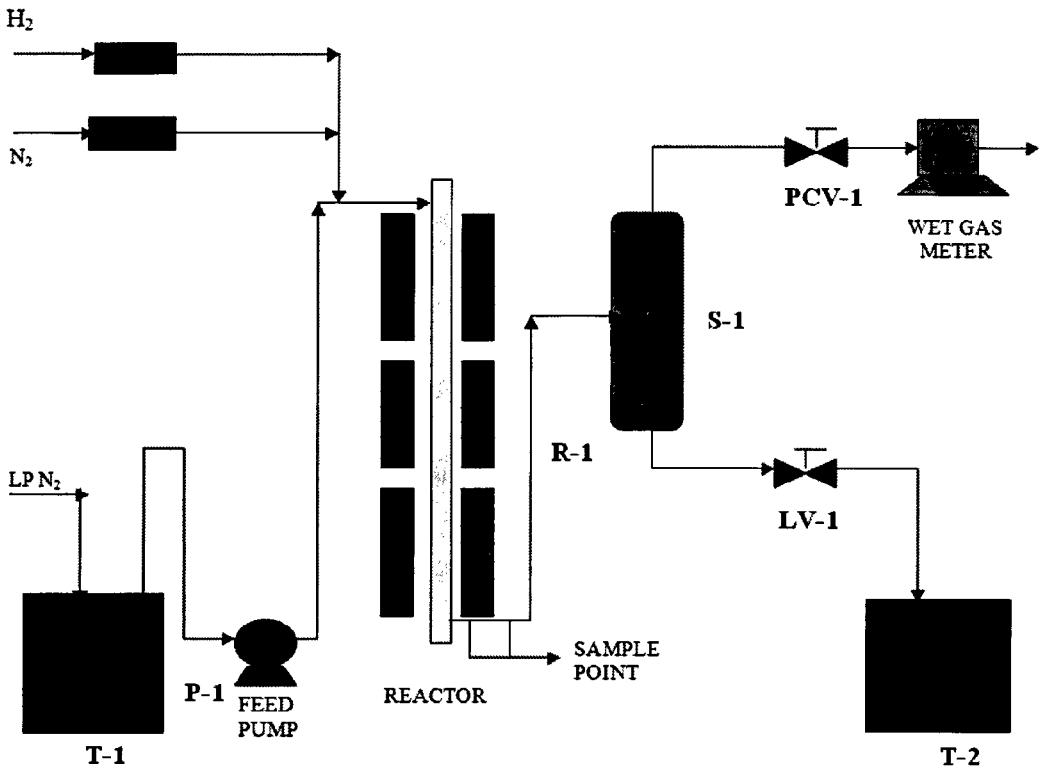
FIG. 4 illustrates the process flow diagram of the MRU (Micro Reactor Unit) for hydroprocessing.

Full range Coker gasoline (IBP-210° C.) was pretreated for selective saturation of diolefins over a low activity CoMo or NiMo catalyst using Hydroprocessing Micro-reactor unit (MRU) of 20 cc catalyst volume. The process flow diagram of the MRU is shown in FIG. 4. This MRU contains a fixed bed reactor, which is equipped with electrical furnace, which can heat the reactor up to 500° C. The furnace is divided into three different zones. The top zone is used for preheating the feed stream before entering the process zones. The middle zone is used for process reactions and bottom zone is used for post heating purposes. Adjusting the corresponding skin temperatures controls the reactor internal temperatures. The feed was charged into a feed tank (T-1), which can preheat the feedstock up to about 100° C. The feed was then pumped through a diaphragm pump (P-1). The Mass Flow Controller for measurement of hydrogen gas is equipped in the inlet of the reactor. The liquid hydrocarbon and hydrogen gas join together and enter into the reactors in down flow mode. The isothermal temperature profile was maintained throughout the catalyst bed. The reactor effluent stream then enters to Separator (S-1), where gas and liquid streams were separated. The gas stream exit from the top of the separator and sent to vent via a pressure control valve (PV-1) and wet gas meter (FQI-1). The liquid stream exit from the bottom of the separator and collected in product tank (T-2) through a level control valve (LV-1). The hydrocarbon feed and reactor effluent samples were analyzed for various properties. The details of operating parameters and feed/product properties are shown below in Table-1.

TABLE 1

| | Feed | Prod-1 | Prod-2 | Prod-3 | Prod-4 | Prod-5 | Prod-6 | Prod-7 |
|---|---|---|---|---|---|---|---|---|
| a) Operating Parameters | | | | | | | | |
| 1. Pressure, bar | | 10 | 10 | 10 | 10 | 10 | 10 | 10 |
| 2. Temperature, ° C. | | 100 | 120 | 140 | 160 | 170 | 180 | 190 |
| 3. LHSV, $hr^{-1}$ | | 5 | 5 | 5 | 5 | 5 | 5 | 5 |
| 4. $H_2$/HC ratio, $Nm^3/m^3$ | | 25 | 25 | 25 | 25 | 25 | 25 | 25 |
| b) Feed product properties | | | | | | | | |
| 1. Total Sulfur, ppm | 2900 | 2900 | 2900 | 2900 | 2800 | 2800 | 2700 | 2600 |
| 2. Mercaptan Sulphur, ppm | 427 | 450 | 580 | 572 | 600 | 654 | 715 | 648 |
| 3. Density @ 15° C. (g/cc) | 0.7191 | 0.7161 | 0.7158 | 0.7164 | 0.7177 | 0.7128 | 0.7135 | 0.7126 |
| 1. Sim. TBP (ASTM D-2887) | | | | | | | | |
| Weight % | Temperature, ° C. | | | | | | | |
| IBP | 55.4 | 53.5 | 55.1 | 55.8 | 53.9 | 55.3 | 53 | 55.8 |
| 5 | 56.9 | 56.6 | 56.9 | 62.4 | 56.9 | 57 | 56 | 57.5 |
| 10 | 57.7 | 57.3 | 58.3 | 66.7 | 57.6 | 62.5 | 56.6 | 63.7 |
| 30 | 68.4 | 70.2 | 74.8 | 86.1 | 69.4 | 71 | 66.1 | 73.6 |
| 50 | 89.9 | 93.5 | 96.6 | 98.6 | 92.2 | 92.6 | 81.9 | 96.9 |
| 70 | 104.2 | 110 | 112 | 114.8 | 106.6 | 110 | 99.4 | 111.3 |
| 90 | 126 | 131.8 | 142.1 | 139 | 128.4 | 127.2 | 123.4 | 131.1 |
| 95 | 146.8 | 150.8 | 147.9 | 156.2 | 148.4 | 143.6 | 139 | 148.5 |
| FBP | 202.8 | 206.3 | 205.6 | 204.4 | 204.4 | 203.6 | 205.7 | 206.5 |

TABLE 1-continued

| | Feed | Prod-1 | Prod-2 | Prod-3 | Prod-4 | Prod-5 | Prod-6 | Prod-7 |
|---|---|---|---|---|---|---|---|---|
| 4. Olefin, wt % | 49.2 | 48.4 | 50.0 | 49.8 | 48.1 | 49.0 | 50.4 | 48.3 |
| 5. Diolefin, wt % | 1.0 | 0.98 | 0.97 | 0.94 | 0.06 | 0.05 | .02 | 0.03 |
| 6. RON | 90.1 | 90.2 | 90.0 | 90.0 | 90.3 | 90.0 | 90.4 | 90.2 |

Example-2

Full range Coker gasoline (IBP-210° C.) was hydrotreated over conventional commercial HDS catalyst using Hydroprocessing Micro-reactor unit (MRU) of 20 cc catalyst volume. The hydrocarbon feed and product samples were analyzed for various properties. The details of operating parameters and feed/product properties are shown below in Table-2.

TABLE 2

| | Feed | Prod-5 | Prod-6 | Prod-7 | Prod-8 | Prod-9 |
|---|---|---|---|---|---|---|
| a) Operating Parameters | | | | | | |
| 1. Pressure, bar | | 30 | 30 | 30 | 30 | 30 |
| 2. Temperature, ° C. | | 200 | 250 | 300 | 320 | 350 |
| 3. LHSV, $hr^{-1}$ | | 2.5 | 2.5 | 2.5 | 2.5 | 2.5 |
| 4. $H_2$/HC ratio, $Nm^3/m^3$ | | 200 | 200 | 200 | 200 | 200 |
| b) Feed product properties | | | | | | |
| 1. Total Sulfur, ppm | 2900 | 2500 | 911 | 55 | 50 | 40 |
| 2. Mercaptan Sulphur, ppm | 427 | 767 | 124 | 0 | 0 | 0 |
| 3. Density @ 15° C. (g/cc) | 0.7191 | 0.712 | 0.7105 | 0.709 | 0.7085 | 0.708 |
| 4. Sim. TBP (ASTM D-2887) | | | | | | |
| Weight % | | | Temp., ° C. | | | |
| IBP | 55.4 | 54.2 | 53.9 | 53.2 | 55.3 | 53.2 |
| 5 | 56.9 | 58.3 | 55.8 | 56 | 56.7 | 56 |
| 10 | 57.7 | 65.4 | 58.6 | 57.1 | 57.4 | 57 |
| 30 | 68.4 | 78.8 | 70.5 | 68.6 | 68.7 | 68.2 |
| 50 | 89.9 | 95.8 | 93.2 | 88.5 | 87.9 | 86.6 |
| 70 | 104.2 | 101.4 | 102 | 102.2 | 101.9 | 101.3 |
| 90 | 126.0 | 108.8 | 123.2 | 124.6 | 124.9 | 124.1 |
| 95 | 146.8 | 138.2 | 135.8 | 142.7 | 137.9 | 137.5 |
| FBP | 204.5 | 203.3 | 204.2 | 202.4 | 201.5 | 201.3 |
| 5. Olefins, wt % | 49.2 | 46.0 | 19.9 | 1.2 | 1.5 | 0.5 |
| 6. RON | 90.9 | 90.3 | 85.5 | 80.3 | 80.7 | 80.5 |

Example-3

Figure 5:
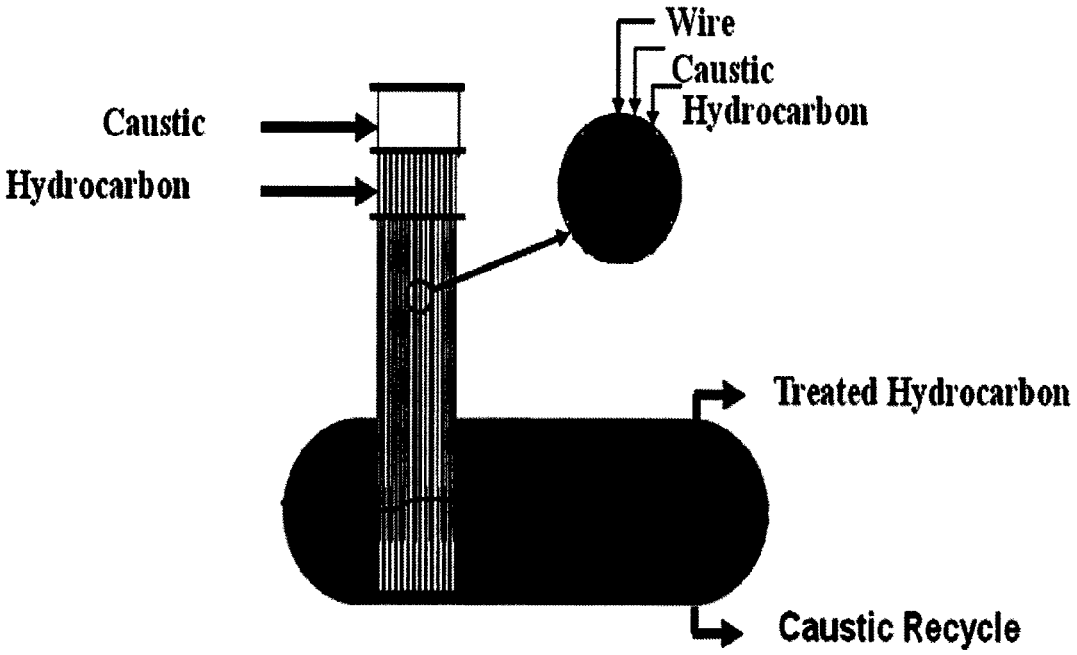
FIG. 5 shows the process flow diagram of CFC.

Full range Coker gasoline (IBP-210° C.) was split into three cuts i.e. Light Cut (IBP-70° C.), intermediate Cut (70-90° C.) and (90-210° C.) using TBP distillation apparatus. The light cut containing about 80% high octane value olefins and sulfur in the form of mercaptans is desulfurized with caustic treatment using Continuous Film Contactor (CFC). The process flow diagram of CFC is shown in FIG. 5. In CFC, the hydrocarbon and the caustic or amine streams are fed separately through a two stage distributor to the contacting device with uniformly packed and specially treated and shaped longitudinal SS wires. These wires are preferentially wetted by aqueous stream. In this process, an enormous interfacial surface area of contact is created without using any dispersive energy, which makes this device highly efficient. Thus, separation of the phases following the contacting is achieved with much ease and without any entrainment.

Intermediate Cut was also desulfurized with caustic treatment using CFC. The Heavy Cut was desulfurized in MRU using commercial HDS catalyst and reactive adsorbent. The properties of various cuts after splitting are shown below in Table-3.

TABLE 3

| Property | Full range Coker Naphtha | Light Cut | Inter-mediate Cut | Heavy Cut |
|---|---|---|---|---|
| 1. Total Sulfur, ppm | 2400 | 240 | 360 | 4600 |

TABLE 3-continued

| Property | Full range Coker Naphtha | Light Cut | Inter-mediate Cut | Heavy Cut |
|---|---|---|---|---|
| 2. Mercaptan Sulphur, ppm | 427 | 230 | 340 | 50 |
| 3. Density @ 15° C. (g/cc) | 0.7191 | 0.6793 | 0.7045 | 0.7482 |
| 4. Boiling range, ° C. | IBP-205 | IBP-70 | 70-90 | 90-205 |
| 5. Olefin, wt % | 49.2 | 82.0 | 60.0 | 20.0 |
| 6. Benzene, wt % | 0.73 | 0.10 | 2.48 | 0.45 |
| 7. RON | 90.1 | 97.0 | 90.0 | 85.0 |

The properties of various cuts after desulfurization by Process Scheme-1 are shown below in Table-4.

TABLE 4

| Property | Light Cut Treated in CFC | Intermediate Cut Treated in CFC | Heavy Cut after hydrotreating | Total product |
|---|---|---|---|---|
| 1. Total Sulfur, ppm | 7 | 12 | 15 | 12 |
| 2. Density @ 15° C. (g/cc) | 0.6793 | 0.7045 | 0.7402 | 0.7123 |
| 3. Olefins, wt % | 80.0 | 60.0 | 1.5 | 40.8 |
| 4. RON | 97.0 | 90.0 | 81.5 | 88.2 |

By using Process Scheme-1 overall octane loss is about 1.9 units and overall hydrogen consumption is about 0.5 wt % of total feed.

The properties of various cuts after desulfurization by Process Scheme-2 are shown below in Table-5.

TABLE 5

| Property | Light Cut Treated in CFC | Intermediate Cut Treated in CFC | Heavy Cut after treating in reactive adsorption process | Total product |
|---|---|---|---|---|
| 1. Total Sulfur, ppm | 7 | 12 | 4 | 7 |
| 2. Density @ 15° C. (g/cc) | 0.6793 | 0.7045 | 0.7455 | 0.7142 |
| 3. Olefins, wt % | 80.0 | 60.0 | 15.0 | 47.0 |
| 4. RON | 97.0 | 90.0 | 83.0 | 89.6 |

By using Process Scheme-2 overall octane loss is about 0.5 units and overall hydrogen consumption is about 0.10 wt % of total feed.

The comparison of properties of desulfurized gasoline as per conventional HDS system and present invention is shown below in Table-6.

TABLE 6

| Property | Coker Gasoline after treating in conventional HDS | Coker Gasoline after treating as per present invention (Scheme-1) | Coker Gasoline after treating as per present invention (Scheme-2) |
|---|---|---|---|
| 1. Total Sulfur, ppm | 50 | 9 | 7 |
| 2. Density @ 15° C. (g/cc) | 0.7085 | 0.7141 | 0.7142 |
| 3. Olefins, wt % | 1.5 | 40.8 | 47.0 |
| 4. RON | 80.5 | 88.2 | 89.6 |

Example-4

Full range Coker gasoline (IBP-210° C.) was splitted is into three cuts i.e Light Cut (IBP-70° C.), Intermediate Cut (70-90° C.) and (90-210° C.) using TBP distillation apparatus. The Light cut is desulfurized with caustic treatment using CFC. Intermediate Cut was separated for disposal in isomerization or reformer unit to reduce benzene content in gasoline pool to meet desired specification. The Heavy Cut was desulfurized in MRU using conventional commercial HDS catalyst and reactive adsorbent. The properties Light and Heavy cuts after desulfurization are shown below in Tables-7 and 8.

TABLE 7

| Property | Light Cut Treated in CFC | Heavy Cut after hydrotreating | Total product (Light + Heavy) |
|---|---|---|---|
| 1. Total Sulfur, ppm | 7 | 9 | 8 |

TABLE 7-continued

| Property | Light Cut Treated in CFC | Heavy Cut after hydrotreating | Total product (Light + Heavy) |
|---|---|---|---|
| 2. Density @ 15° C. (g/cc) | 0.6793 | 0.7402 | 0.7142 |
| 3. Olefins, wt % | 82.0 | 1.5 | 35.8 |
| 4. Benzene, wt % | 0.1 | 0.45 | 0.3 |
| 5. RON | 97.0 | 81.5 | 87.8 |

TABLE 8

| Property | Light Cut Treated in CFC | Heavy Cut after treating in reactive adsorption process | Total product (Light + Heavy) |
|---|---|---|---|
| 1. Total Sulfur, ppm | 7 | 4 | 5 |
| 2. Density @ 15° C. (g/cc) | 0.6793 | 0.7455 | 0.7166 |
| 3. Olefins, wt % | 82.0 | 15.0 | 43.5 |
| 4. Benzene, wt % | 0.1 | 0.45 | 0.3 |
| 5. RON | 97.0 | 83.5 | 89.0 |

Advantages

The present invention is particularly advantageous in desulfurization of full range gasoline c, as it obviates considerable consumption of hydrogen and significantly reduces fuel octane loss due to olefin saturation.

This invention has a further advantage of bringing down sulfur content below 10 ppm and diolefin to 0.1% with a minimum loss of octane number by 1-2 units.

While the invention has been described in detail and with reference to the specific embodiments thereof, it will be apparent to one skilled in the art that various changes and modifications can be made therein without deviating or departing from the spirit and scope of the invention. Thus the disclosure contained herein includes within its ambit the obvious equivalents and substitutes as well.

Having described the invention in detail with particular reference to the illustrative examples given above and the accompanying drawings, it will now be more specifically defined by means of claims appended hereafter.

We claim:

1. A process for deep desulfurization of cracked gasoline feed stock to reduce sulfur content to <10 ppm with minimum octane loss and reduced hydrogen consumption comprising of the following steps:

(a) reduction of diolefins content below 0.10% by treating with low activity NiMo or CoMo catalyst, at a pressure in the range 5 to 10 bar, temperature in the range of 100 to 200° C., hydrogen to hydrocarbon ratio from 5 to 25 depending on diolefin content in the feed;

(b) splitting of full range gasoline by distillation into the following three different cuts, including light cut in the range of IBP-70° C., intermediate cut in the range of 70 to 90° C. and heavy cut in the range of 90 to 210° C. which is thereafter blended in gasoline;

(c) treatment of the light and/or intermediate cuts with 2-10% caustic solution in CFC to reduce mercaptan sulfur which is thereafter blended in gasoline;

(d) treatment of the heavy cut and, optionally, the intermediate cut by passing over a reactive adsorbent bed which is thereafter blended in gasoline;

(e) reduction of benzene content of gasoline by routing the intermediate cut into isomerization or reformer unit;

wherein the treatment of step (d) is carried out at a pressure in the range 5 to 20 bar, temperature in the range of 250 to 300° C., hydrogen to hydrocarbon ratio from 20 to 200 depending on sulfur and olefin content in the feed, to reduce sulfur preferably below 15 ppm, and blended in gasoline pool; wherein the overall octane loss is less than about 0.5 units and overall hydrogen consumption is less than about 0.5 wt % of total feed.

2. The process as claimed in claim 1, wherein the diolefins content is reduced to a level less than 0.05%.

3. The process as claimed in claim 2, wherein the diolefins content reduced to a level less than 0.02%.

4. The process as claimed in claim 1, wherein sulphur is reduced below 10 ppm.

5. The process as claimed in claim 4, wherein sulphur is reduced below 5 ppm.

6. The process as claimed in claim 1, wherein intermediate and/or heavy cuts are subjected to catalytic treatment, the catalyst being CoMo or NiMo catalyst, at a pressure in the range 10 to 30 bar, temperature in the range of 250 to 300° C., hydrogen to hydrocarbon ratio varying between 20 to 200 depending on sulfur and olefin content in the feed, to reduce sulfur preferably below 30 ppm, and blended in gasoline.

7. The process as claimed in claim 6, wherein sulphur is reduced below 10 ppm.

8. The process as claimed in claim 6, wherein sulphur is reduced below 5 ppm.

9. A process as claimed in claim 1, wherein the reactive adsorbent comprises a bimetallic alloy generated in situ from mixed metal oxides, is capable of being regenerated by controlled oxidation of the adsorbed carbon and sulfur with lean air followed by activation with hydrogen, and wherein the presence of hydrogen in the course of adsorption prevents deactivation of adsorbent due to coking.

* * * * *